US005088262A

United States Patent [19]

Miller et al.

[11] Patent Number: 5,088,262

[45] Date of Patent: Feb. 18, 1992

[54] ANCHOR SYSTEM FOR INSTALLING AND HOLDING SHEET INSULATION FUNCTIONALLY IN PLACE AND METHOD OF USE

[75] Inventors: Thomas M. Miller, Walnut, Calif.; Raymond J. Schraff, Cleveland, Ohio

[73] Assignee: Industrial Insulations, Inc., City of Industry, Calif.

[21] Appl. No.: 574,218

[22] Filed: Aug. 29, 1990

[51] Int. Cl.[5] ..... E04B 1/00

[52] U.S. Cl. ..... 52/745; 52/404; 52/509; 110/336; 110/334; 432/248

[58] Field of Search ..... 52/404, 712, 715, 699, 52/700, 408, 407, 410, 765, 745, 746, 748, 509; 110/336, 339, 340; 432/248

[56] References Cited

U.S. PATENT DOCUMENTS 4,336,086 6/1982 Rast ..... 52/765 X 4,955,809 9/1990 Viertola ..... 110/336 X

*Primary Examiner*—Richard E. Chilcot, Jr.

*Attorney, Agent, or Firm*—Breiner & Breiner

[57] ABSTRACT

An anchor system including a C-track and a two-pronged anchor capable of installing and holding sheet insulation material on a support surface in a compressed state is described. The method of installation utilizing the anchor system of the present invention provides for both the attachment of the insulation to the support surface and compression of the insulation during a single installation operation. The method involves forming a plurality of folds with the sheet insulation to a desired height followed by the insertion of one prong of the two-pronged anchor through the folds to compress the folds and hold the folds in position. The second prong of the anchor initially serves to aid in the compression of the folds and secondarily serves to connect the compressed insulation to a next layer of folds formed and stacked on top of the already formed folds. The use of a separate attachment means with each fold of the insulation material is not required. The anchors can optionally contain a means of interengaging the anchors.

12 Claims, 2 Drawing Sheets

FIG. 1
FIG. 2
FIG. 3
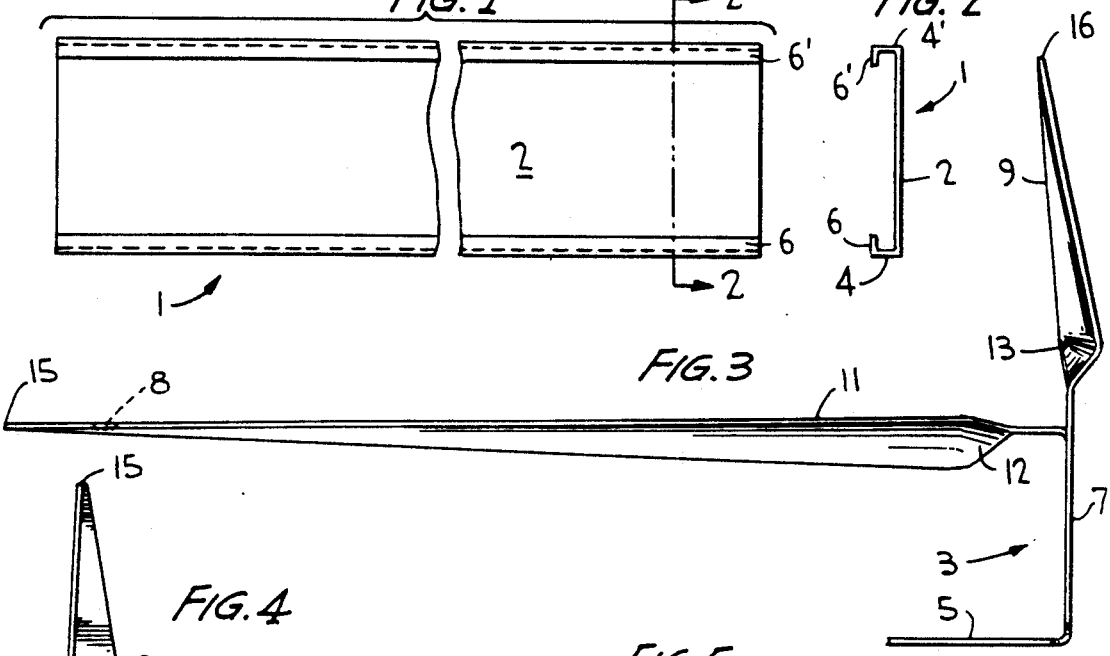
FIG. 4
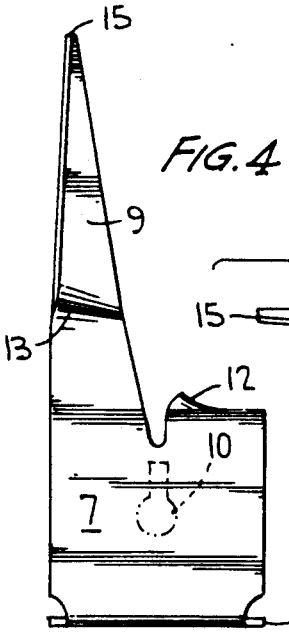
FIG. 5
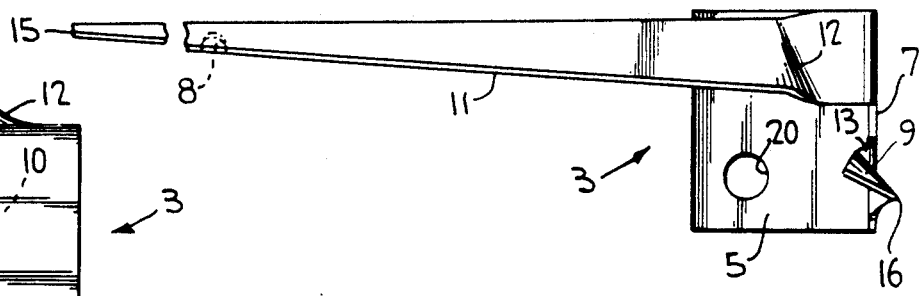
FIG. 6
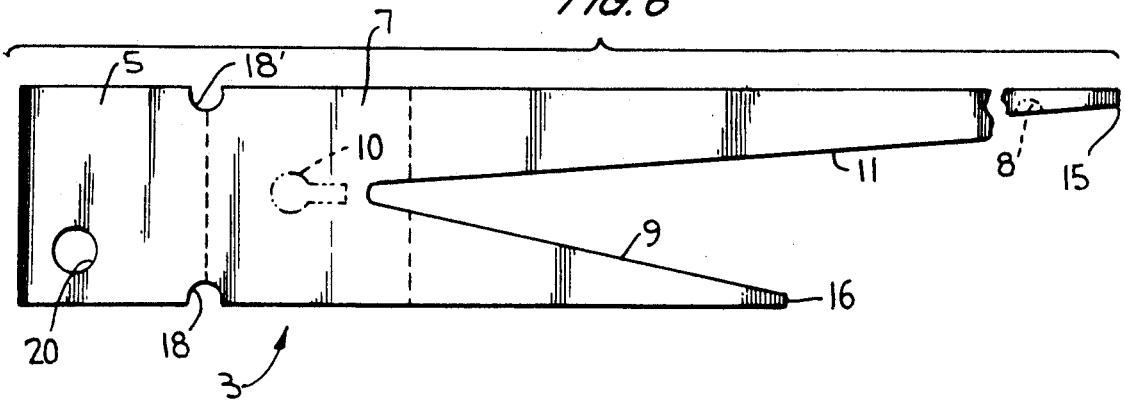

ANCHOR SYSTEM FOR INSTALLING AND HOLDING SHEET INSULATION FUNCTIONALLY IN PLACE AND METHOD OF USE

FIELD OF THE INVENTION

The present invention is directed to an anchor system suitable for installing and holding sheet or blanket heat insulation material functionally in place on a structural support surface, such as a furnace wall, a ladle cover or the like. The anchor system includes a length of C-track in combination with a two-pronged anchor. The anchor is slidably movable within the C-track.

BACKGROUND OF THE INVENTION

Various means of attachment for installing heat insulation on support surfaces are known in the art. Insulation can be installed in the form of modules or blocks, or in sheet or blanket form. Due to the physical nature of the material from which heat insulation is generally composed, and the use of the insulation in high temperature environments, it is preferred that the insulation be compressed prior to or during the installation thereof so that when the heat insulation is exposed to high temperatures and heat shrinkage is induced therein, gaps will not be formed between the pieces of insulation reducing the heat protection provided by the insulation to the support surface. Compression allows for expansion of the insulation thereby compensating for any heat shrinkage of the insulation which may occur.

A method currently used in the art for installing insulation is the use of insulation modules or blocks which allow the insulation to be compressed prior to installation of the insulation on a desired surface. Therefore, as shown in U.S. Pat. Nos. 4,001,996; 4,493,176; and 4,381,634, the attachment means utilized with the separate modules are sectional in that a separate attachment means is required for each module in order for the module to be installed on a support surface. The attachment means present on each module operates in conjunction with a complementary attachment means affixed on the support surface.

While block insulation can be made in a compressed state, sheet or blanket heat insulation generally has to be compressed at the time it is installed. Alternatively, an auxiliary compression means is present for acting on the insulation to initially compress the insulation and maintain that compression following heat-induced shrinkage of the insulation.

Sheet insulation is usually installed by lapping or forming folds with the insulation. A rod or other support means is generally positioned inside each fold abutting the support surface. The rod and fold are then held in place by another means, such as a tie or hook member. The tie or hook member is connected to the support surface in a suitable manner. When ties or hooks are utilized, a plurality of ties or hooks are required, essentially one per fold. The attachment of each of these individual ties or hooks to the support surface is time consuming. The time necessary for installation is further enlarged resulting in a labor intensive operation when compression of a plurality of folds is required upon installation of the insulation, i.e. pressure is placed on the sheet material to properly compress and position the insulation prior to tying or hooking followed by the tying and hooking in that position. An example of the use of ties or hooks for securing rod-containing folds of sheet insulation material is shown in U.S. Pat. No. 4,606,473.

Alternatively, an auxiliary compression means, such as shown in U.S. Pat. No. 4,791,769, can be utilized to provide compression of the insulation. The use of an auxiliary compression means, however, involves additional time and cost due to the added materials and installation of those materials.

The present invention is directed to an anchor system suitable for installing and securing sheet heat insulation material in a compressed state to a support surface. The anchor system allows for the installation and compression of the insulation through a single installation operation. The anchor system of the present invention uses fewer attachment means than the systems known in the art. The use of an auxiliary compression means is not required. Accordingly, the time and labor involved in the installation of the sheet insulation according to the present invention is reduced compared to the procedures known in the art resulting in a more efficient and economical system.

OBJECTS OF THE INVENTION

A primary object of the present invention is to provide an anchor system useful for installing and maintaining sheet heat insulation material on a support surface in such a manner as to make the insulation suitable for use in high temperature environments.

A further primary object of the present invention is to provide an anchor system which includes a C-track used in combination with a two-pronged anchor for securing sheet heat insulation in a compressed state upon a support surface.

A further primary object of the present invention is a method of installing sheet heat insulation using an anchor system which allows for the compression and holding of the insulation in place during the same installation operation of the insulation.

BRIEF DESCRIPTION OF THE INVENTION

The anchor system of the present invention includes at least one length of C-track, at least one anchor having a base, a side wall and two prongs extending from the top of the side wall wherein one prong is longer in length than the other prong. The longer prong is bent at approximately a 90° angle to the side wall and the shorter prong initially extends straight up from the side wall. During installation of insulation, the shorter prong will be bent to extend in a direction opposite to the longer prong. The anchor system is used to install sheet heat insulation material on a surface which will be exposed to high temperatures, such as the hot face of a furnace wall, ladle cover or the like.

The method of installing sheet insulation using the anchor system of the present invention includes first affixing one or more lengths of C-track to a desired support surface. The number of C-tracks utilized will depend upon the surface area to be covered. Thereafter, insulation of any suitable thickness, which is preferably in the form a one-piece continuous roll of insulation, is laid out in a lengthwise direction to form one or more folds or loops across the width of the C-tracks and surface being covered. The insulation roll is applied so that the folds formed preferably interlap. A rod can, optionally, be positioned in each fold of the insulation which abuts the support surface to assist in maintaining the insulation in position during installation thereof. However, such rod, if used, is preferably not anchored to the surface being covered. A plurality of folds are built-up or stacked on the face of the support surface to equal a height greater than the length of the longer prong of the anchor. At that time, an anchor is inserted into the C-track in such a manner that when the anchor is slid down the C-track toward the stacked folds, the long prong will be pushed into and through the built-up folds of insulation. During this sliding and pushing motion, the folds are compressed together by the anchor. The short prong at this time is extended across the top surface of the folds and serves to provide additional downward pressure. Following the insertion of the anchor, the anchor can be allowed to float in the C-track or can be anchored down therein by a bolt or the like. Prior to placing the next layer of insulation on the installed folds, the short prong is bent upward so that it extends in a direction opposite to the long prong. When the next fold of insulation is installed, the fold will be pressed onto the short prong. The short prong thereby acts to connect the fold sections together and stabilize the insulation.

In an alternative embodiment, the long prong can have a notch formed in one of its side edges in the proximity of the free end of the long prong and a keyhole formed in the side wall portion of the anchor. When a second and subsequent anchors are inserted into the C-track and pushed through the build up folds of insulation, the notch on the long prong of the second or subsequent anchor can be inserted into the keyhole present in the previously inserted anchor thereby interengaging the anchors and holding the anchors in a joined relationship. This serves to better hold the insulation folds in a compressed state both during and subsequent to installation. An alternative interengagement means is to weld the free end of the long prong to the side wall of the previously inserted anchor.

The anchor system of the present invention allows for the combined installation and compression of the sheets of heat insulation in one operation without the necessity of affixing each separate fold of insulation to a support surface, or the use of an auxiliary compression means therewith. The method of installing the sheets of heat insulation with the anchor system of the present invention is thereby labor and time efficient and economical. The use of a separate attachment means with each fold of insulation is not required.

BRIEF DESCRIPTION OF DRAWINGS

FIG. 1 is a top plan view of the C-track of the anchor system.

FIG. 2 is a cross-sectional view of the C-track taken along line 2—2 FIG. 1.

FIG. 3 is a side elevational view of the two-pronged anchor of the anchor system of the present invention with the prongs positioned for installation and compression of a plurality of folds of insulation material.

FIG. 4 is a back elevational view of the anchor as shown in FIG. 3.

FIG. 5 is a top plan view of the anchor as shown in FIG. 3.

FIG. 6 is a top plan view of the anchor in a flattened state following manufacture thereof prior to bending of the anchor to form the anchor as shown in FIG. 3.

DESCRIPTION OF THE PRESENTLY PREFERRED EMBODIMENT

Figure 7:
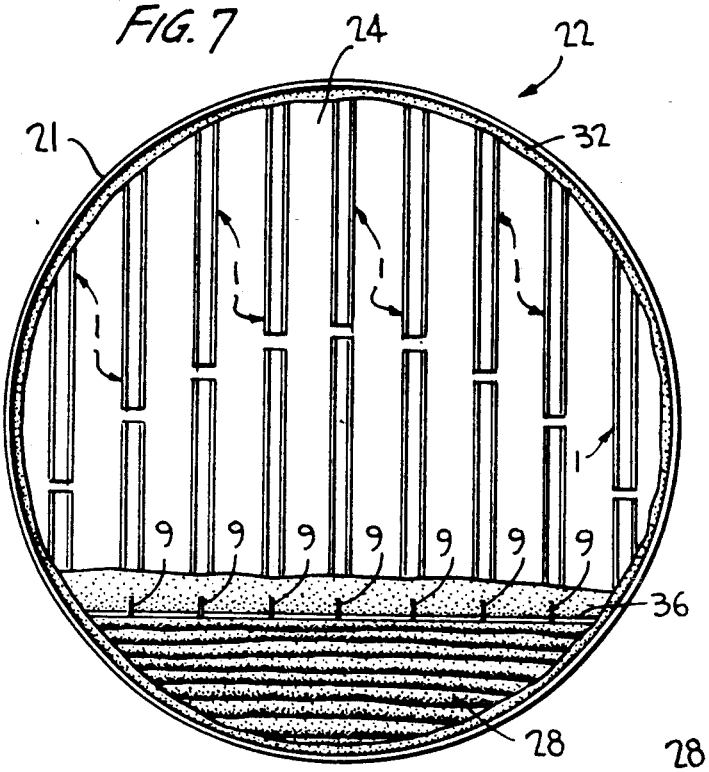
FIG. 7 is a front elevational view of the hot face of a ladle cover having a portion of sheet heat insulation installed thereon in folds utilizing the anchor system of the present invention.

The anchor system and method of using the anchor system to install heat insulation sheets of the present invention is now described in relation to the drawings. Sheet insulation usable with the present invention is any conventionally known sheet insulation material, such as ceramic fiber, capable of being lapped or folded.

The anchor system of the present invention includes a suitable length of C-track 1 and an anchor 3. The number of C-tracks and anchors used in installing insulation will depend on the amount of surface area to be covered.

A length of C-track, as best shown in FIGS. 1 and 2, has a back wall 2, two side walls 4 and 4' and two upper surfaces 6 and 6'. Upper surfaces 6 and 6' are not joined resulting in the track having a C-configuration. The length(s) of the C-track utilized will depend upon the size of the surface to be covered by insulation. The C-track is preferably made from metal sheet material.

Anchor 3 is also preferably made from metal sheet material and initially configured in a form as shown in FIG. 6. The flattened sheet metal is then bent appropriately to form an anchor as best shown in FIGS. 3–5. Anchor 3 includes a base 5, a side wall 7, a first prong 9 and a second prong 11. The flattened sheet metal when bent to position the prongs as shown in the figures preferably includes a twist, as denoted by 12 and 13. These twists serve to aid in the anchoring and holding of the insulation folds by the anchor as will be described further below. Prongs 9 and 11 are tapered so that their free ends 15 and 16 are narrowed to a rounded pointed end.

Base 5 has of a width sufficiently narrow to allow it to slide within C-track 1, but wide enough to prevent it from coming out between the ends of upper surfaces 6 and 6'. Notches 18 and 18' are formed in the anchor at the point where base 5 meets side wall 7 so that when base 5 is positioned and slid in C-track 1, the notches will be adjacent upper surfaces 6 and 6'. This allows for anchor 3 to move smoothly in C-track 1. A hole 20 can optionally be formed in base 5 and can be used to receive a bolt or the like to affix the anchor in a desired location as will be further described below in relation to the installation of the sheet insulation.

Further, anchor 3 can optionally have a notch 8, as shown by dashed lines in FIGS. 3, 5, and 6, formed in second prong 11 and a keyhole 10, as shown by dashed lines in FIGS. 4 and 6, formed in side wall 7. Notch 8 is formed in the proximity of the free end of anchor 3. Notch 8 present in one anchor is used in conjunction with a keyhole 10 present in another anchor to interengage or hold the anchors in a joined relationship during and subsequent to the installation of insulation on a support as is further described below.

Figure 8:
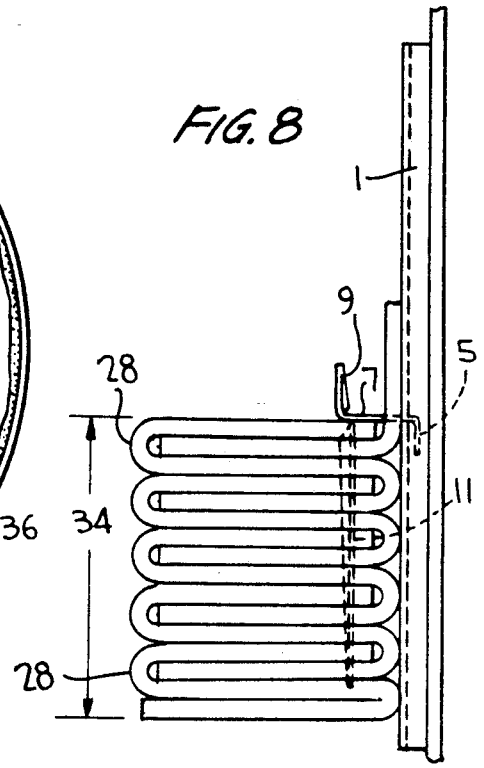
FIG. 8 is a partial side elevational view showing the interrelationship of the sheet insulation, C-track and anchor during installation of the insulation on a ladle cover as shown in FIG. 7 with the prongs positioned following securement and compression of a first set of insulation folds and prior to installation of a second set of folds thereon.
Figure 9:
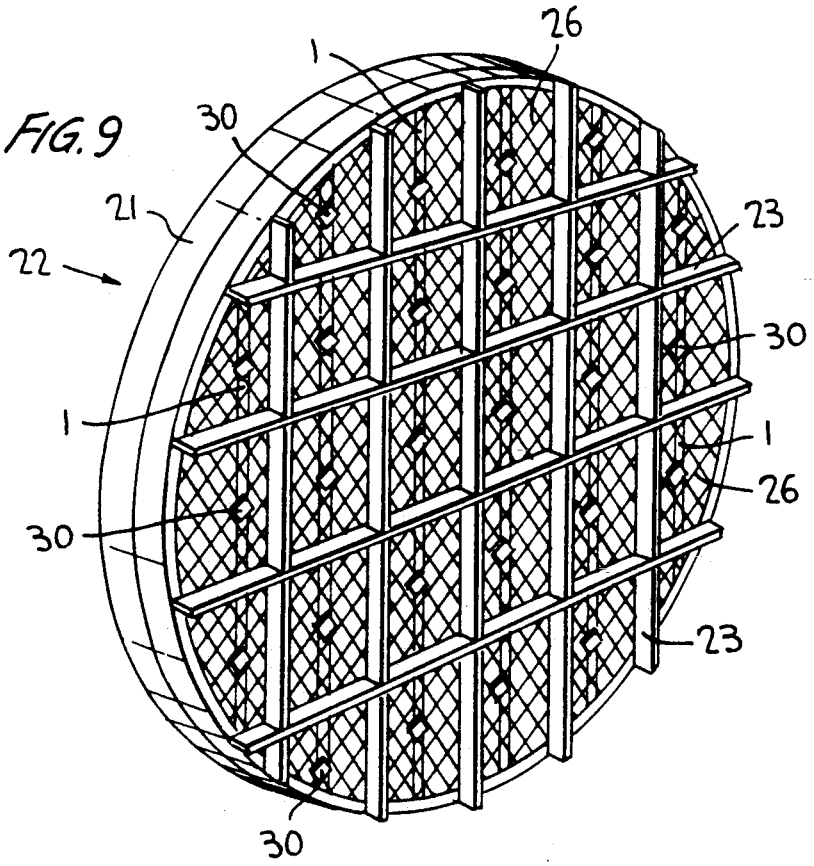
FIG. 9 is a perspective view of the backside or cold face of the ladle cover shown in FIG. 7.

In describing the method of installing sheet insulation using the above-described anchor system, description will be made with reference to installing insulation sheets on the hot face of a ladle cover as shown in FIGS. 7–9. However, the anchor system and method of installing insulation as described herein can be utilized with differing support surfaces, such as a hot face of a furnace wall. Accordingly, while the invention is described in relation to the hot face of a ladle cover, such description is not to limit the scope of the present invention.

A ladle cover 22 generally includes a ring-like side wall 21 having a supporting framework 23. A wire mesh 26 is mounted inside ring 21 on framework 23. The wire mesh is attached to the hot face side of framework 23 and will act as the support surface for the insulation to be installed on the hot face of the ladle cover.

Prior to attachment of the anchor system and sheet insulation to the hot face of ladle cover 22, a preliminary blanket of insulation 24 can optionally, and is preferably, spread across the hot face of ladle cover 22 over wire mesh 26. Thereafter, a plurality of lengths of C-track 1 are affixed to wire mesh 26. The C-track can be divided into a plurality of lengths which are aligned, such as shown in FIG. 7, to allow for ease in handling of the C-track when a large surface area is to be covered. The C-track can be affixed to the support surface by any suitable means. A fastening means, such as denoted by 30, which interlocks or sandwiches the support surface between the C-track and fastening means can be utilized. Fastening means 30 can be attached to the C-track by any suitable means, such as a bolt or the like. The bolt necessarily will not project into the C-track to a depth sufficient to impede the sliding movement of anchor 3 in the C-track.

Prior to installing the sheet insulation, a gasket or seal 32, also made of insulation material, can optionally be positioned around the edge of the hot face being insulated to provide added protection.

Rolls of one-piece, i.e. continuous, sheet insulation material are then utilized to form folds 28 on the hot face of the ladle cover. The folds can preferably take the form of C-folds or S-folds. The folds are formed in a stacking relationship to one another and are preferably interfolded or interlapped during their formation. Interlapped S-folds are shown in FIG. 8. The interlapping or interfolding of the insulation provides for more complete heat protection of the ladle cover and stability to the stacked folds. It is to be understood that the folds can be formed by simply stacking lengths of sheet insulation in layers. Folds such as C-folds and S-folds, however, are preferred since the connecting sheet portion of these folds provide added protection to the support. This protection is enhanced further by the interlapping of the C- or S-folds.

Due to the use of one-piece sheets of insulation, folds 28 formed on the hot face surface are continuous widthwise lengths which do not include any breaks therein. The folds are formed in a stack to a height 34 which is greater than the length of prong 11 of anchor 3. When this height has been obtained, an anchor is slid into each C-track present with prong 11 facing downward and prong 9 facing upward from side wall 7 as shown in FIG. 3. When anchor 3 is slid down C-track 1 to the folded insulation, prong 11 is forced into and through the plurality of insulation folds 28, as shown in FIG. 8, forcing folds 28 down together into a compressed state and serving to hold the folds together in that state. Twist 12, which is preferably formed in prong 11, aids in maintaining anchor 3 in place in the plurality of insulation folds. Prong 9, when in the position as shown in FIG. 3, extends across the top surface of the uppermost fold when prong 11 is pushed into the plurality of folds and thereby serves to uniformly press down against the folds thereby assisting in the compression of folds 28.

Once the anchor is in position, it can be allowed to float free in the C-track or can be fixed in position, such as by a bolt passing through hole 20 which can be formed in base 5 of anchor 3.

Prior to installing additional insulation folds, prong 9 is preferably bent upward as best shown in FIG. 8. Accordingly, when additional folds of insulation are stacked on top of the now compressed folds 28 on the hot face, the new folds will be pressed onto prong 9. Prong 9 thereby acts to hold the different fold sections together and provide stability to the folds as further insulation is applied to the hot face of the ladle cover. Prong 9 preferably also has a twist formed therein. When folds are pressed onto prong 9, the twist serves to assist in holding the insulation thereon.

The above-described procedure is then repeated, i.e. a plurality of folds are formed to a desired height followed by the insertion of an anchor and compression of the folds, until the entire hot face of the support surface is covered. Necessarily, when the last fold is formed, prong 9 can remain in its initial outward extended position.

If anchors containing a notch 8 and keyhole 10 are utilized in the installation process, the anchors can be joined to each other at the time prong 11 is forced through a plurality of folds 28 to compress the insulation folds. When a first anchor has been inserted into a stack of folds and a second stack of folds built up thereon, a second anchor is inserted into C-track 1 and slid down the track so that prong 11 is forced through folds 28 of the second stack of folds to compress the folds. To better maintain the insulation folds in a compressed state, prong 11 of the second anchor is pressed inward toward the hot face of ladle cover 22 so that free end 15 of prong 11 is positioned to be in alignment with keyhole 10 of the previously inserted anchor. The second anchor is then slid down in C-track 1 until notch 8 in prong 11 of the second anchor has entered keyhole 10 of the previously inserted anchor. Thereafter, the pressure is released from prong 11 causing notch 8 in prong 11 to press against the side of keyhole 10. Notch 8 thereby serves to hold prong 11 in keyhole 10 by preventing further upward or downward movement of the anchor unless prong 11 is again pressed inward. Folds 28 are then maintained in a compressed state during and subsequent to further installation of insulation folds. The procedure is then repeated with subsequently used anchors in the installation process.

An alternative means of joining adjacent anchors positioned in the same C-track involves welding free end 15 of prong 11 of a subsequently inserted anchor to side wall 7 of a previously inserted anchor.

During the formation of a plurality of folds to a desired height prior to the insertion of an anchor therein, a rod 36 may optionally be placed within one or more of the folds formed which abut the cold side of the hot face. Such rod, however, is not anchored in place. The rod does not have to be removed from the folds prior to positioning of anchor 3 since prong 11 will project beyond the position of the rod. The function of the optional rod or rods is to provide a base to hold or support the insulation material as it is installed.

As will be apparent to one skilled in the art, various modifications can be made within the scope of the aforesaid description. Such modifications being within the ability of one skilled in the art form a part of the present invention and are embraced by the appended claims.

It is claimed:

1. Method of installing heat insulation sheet material to a support surface using an anchoring system comprising at least one C-track, and at least one anchor having a base, a side wall, a first prong and a second prong, wherein said base is slidably held in said C-track, said second prong is longer in length than said first prong and extends at approximately a 90° angle from the top of said side wall, and said first prong extends upward from the top of said side wall and is capable of being bent to extend in a direction opposite that of said second prong, said method comprising the following steps:

(a) affixing at least one of said C-tracks to a support surface;

(b) forming a plurality of folds from sheets of heat insulation material over said C-track with one fold being stacked on top of another fold until said folds equal a height greater than the length of said second prong;

(c) placing at least one of said anchors in said C-track and sliding said anchor in said C-track toward said stacked folds in a manner so that when said anchor is slid in said C-track said second prong passes into and through said folds and said first prong pushes down on the top surface of said folds, causing said folds to compress; and (d) repeating steps (b)–(c) until said support surface is covered by said folds.

2. Method of installing heat insulation sheet material to a support surface using an anchoring system comprising at least one C-track, and at least one anchor having a base, a side wall, a first prong and a second prong, wherein said base is slidably held in said C-track, said second prong is longer in length than said first prong and extends at approximately a 90° angle from the top of said side wall, and said first prong extends upward from the top of said side wall and is capable of being bent to extend in a direction opposite that of said second prong, said method comprising the following steps:

(a) affixing at least one of said C-tracks to a support surface;

(b) forming a plurality of folds from sheets of heat insulation material over said C-track with one fold being stacked on top of another fold until said folds equal a height greater than the length of said second prong;

(c) placing at least one of said anchors in said C-track and sliding said anchor in said C-track toward said stacked folds in a manner so that when said anchor is slid in said C-track said second prong passes into and through said folds and said first prong pushes down on the top surface of said folds, causing said folds to compress;

(d) bending said first prong to extend in a direction opposite that of said second prong; and (e) repeating steps (b)–(d) until said support surface is covered by said folds.

3. A method according to claim 1 or claim 2 wherein said C-track and said anchor are each made of metal.

4. A method according to claim 1 or claim 2 wherein each of said first prong and said second prong has a twist formed therein.

5. A method according to claim 1 or claim 2 wherein said folds are interfolded as said folds are formed and stacked.

6. A method according to claim 1 or claim 2 wherein a rod is positioned in at least one of said folds formed.

7. A method according to claim 1 or claim 2 wherein said folds formed in step (b) are C-folds.

8. A method according to claim 1 or claim 2 wherein said folds formed in step (b) are S-folds.

9. A method according to claim 1 wherein said second prong of said anchor has a notch formed in a side edge thereof in proximity to an end of said second prong which is not attached to said side wall of said anchor, and a keyhole formed in said side wall of said anchor.

10. A method according to claim 2 wherein said second prong of said anchor has a notch formed in a side edge thereof in proximity to an end of said second prong which is not attached to said side wall of said anchor, and a keyhole formed in said side wall of said anchor.

11. A method according to claim 9 wherein in step (d) when said anchor is slid in said C-track in a manner so that said second prong passes into and through said folds, said notch in said second prong is inserted into said keyhole in said anchor previously placed in said C-track according to step (c) so as to join said anchors together.

12. A method according to claim 10 wherein in step (e) when said anchor is slid in said C-track in a manner so that said second prong passes into and through said folds, said notch in said second prong is inserted into said keyhole in said anchor previously placed in said C-track according to step (c) so as to join said anchors together.

* * * * *